United States Patent [19]

Prange

[11] 3,963,543

[45] June 15, 1976

[54] PRIMING FORMULATION FOR RIM FIRE AMMUNITION

[75] Inventor: Neil Prange, Florissant, Mo.

[73] Assignee: Olin Corporation, New Haven, Conn.

[22] Filed: Sept. 4, 1975

[21] Appl. No.: 610,345

[52] U.S. Cl. ..... 149/23; 102/86.5; 149/24; 149/28

[51] Int. Cl.[2] ..... C06C 7/00

[58] Field of Search ..... 102/86.5; 149/23, 24, 149/28

[56] References Cited

FOREIGN PATENTS OR APPLICATIONS 535,596 1/1957 Canada ..... 149/28

*Primary Examiner*—Leland A. Sebastian

*Attorney, Agent, or Firm*—Donald R. Motsko; William W. Jones

[57] ABSTRACT

A priming composition for use in ammunition, which priming composition contains as a frictionator and sensitizer ground zirconium oxide particles in place of glass.

3 Claims, No Drawings

PRIMING FORMULATION FOR RIM FIRE AMMUNITION

This invention relates to a priming composition useful in priming rim fire ammunition, which priming composition contains ground zirconium oxide particles as a frictionator and sensitizer in place of ground glass.

It is, of course, well known that ammunition priming compositions used to form primers for percussion-type ammunition rounds should contain a frictionator and sensitizer for proper operation. This frictionator has most commonly taken the form of ground glass, although other materials have been suggested for use, such as ground carbonacious material, such as hard coal, or the like.

The use of ground glass as a frictionator is generally acceptable for most priming compositions and processes, however, it has been found to provide a priming composition which is too sensitive to provide optimum performance in certain instances wherein the primed cartridge is subjected to subsequent working to its final condition. The high sensitivity of glass-containing priming compositions can result in an undesirably high incidence of deflagration of the primer composition during the subsequent working of the cartridge casing. This phenomenon is termed "pop" and, of course, cannot be tolerated.

My invention relates to a glassless priming composition which may be used to form primers for ammunition. The priming composition of my invention can be used for any type of percussion primer, but has been found to be particularly useful in priming rim fire ammunition wherein the cartridge casing is worked after the priming composition has been deposited in place. The priming composition of my invention contains as a frictionator and sensitizer ground particles of amorphous zirconium oxide ($ZrO_2$), instead of the conventional ground glass. The particle size of the zirconium oxide is perferably less than about 100 mesh. Priming compositions using a ground zirconium oxide frictionator instead of ground glass are found to be sufficiently sensitive to provide satisfactory ignition of the propellant, and yet are not so highly sensitive as to be subject to "pops" during the working after priming operation.

I have found that ground zirconium oxide particles are relatively chemically inert so that they do not react with the other constituents of the priming mixture, and possess sufficient abrasiveness to provide dependable ignition when the ammunition is fired.

A specific example of the glassless priming composition, with percentage given by weight, formed in accordance with my invention comprises: 45% styphnate; 5% tetracene; 7% lead peroxide; 20% to 30% barium nitrate; and 13% to 23% zirconium oxide.

The above example is merely exemplary of a working embodiment of the invention and is not meant to be limiting. For example, the invention can be practised with a priming composition containing a fuel constituent. Additionally, other primary explosives and/or oxidizers can be used in place of those specified.

Since many changes and variations of the disclosed embodiment of the invention may be made without departing from the inventive concept, it is not intended to limit the invention otherwise than as required by the appended claims.

What is claimed is:

1. A glassless priming composition for percussion ignition ammunition, said composition comprising: at least one primary explosive constituent; at least one oxidizing constituent, and ground zirconium oxide particles for use as a frictionator and sensitizer.

2. The composition of claim 1, wherein said zirconium oxide forms about 13% to 23% of the weight of the composition.

3. The composition of claim 1, wherein the size of said zirconium oxide particles is less than about 100 mesh.

* * * * *